US009469573B2

(12) United States Patent
Im et al.

(10) Patent No.: US 9,469,573 B2
(45) Date of Patent: Oct. 18, 2016

(54) METHOD OF MANUFACTURING SALT-COATED HEAT PAPER AND SALT-COATED HEAT PAPER MANUFACTURED THEREBY

(71) Applicant: AGENCY FOR DEFENSE DEVELOPMENT, Daejeon (KR)

(72) Inventors: Chaenam Im, Ansan-si (KR); Jungmin Lee, Seoul (KR); Seungho Kang, Daejeon (KR); Haewon Cheong, Sejong (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 0 days.

(21) Appl. No.: 14/525,367

(22) Filed: Oct. 28, 2014

(65) Prior Publication Data

US 2015/0274607 A1 Oct. 1, 2015

(30) Foreign Application Priority Data

Mar. 27, 2014 (KR) ..... 10-2014-0036062

(51) Int. Cl.

| | |
|---|---|
| ***C06B 21/00*** | (2006.01) |
| ***C06B 45/18*** | (2006.01) |
| ***C06B 33/00*** | (2006.01) |
| ***C06B 45/14*** | (2006.01) |

(52) U.S. Cl.

CPC ..... *C06B 45/18* (2013.01); *C06B 33/00* (2013.01); *C06B 45/14* (2013.01)

(58) Field of Classification Search

CPC ... C06B 21/00; C06B 21/0041; C06B 45/18; C06B 33/00; C06B 45/14

See application file for complete search history.

(56) References Cited

U.S. PATENT DOCUMENTS 3,275,484 A * 9/1966 Foote ..... C06B 33/00 149/38
3,738,872 A * 6/1973 Ziemba ..... F42C 1/10 102/205
3,897,731 A * 8/1975 Bowman ..... C06C 5/06 102/275.5

OTHER PUBLICATIONS

Chae-Nam Im et al., "Effect of Molten Salt Coating on Heat Papers," J. Kieeme, vol. 27, No. 8, pp. 528-534, Aug. 2014, South Korea.

* cited by examiner

*Primary Examiner* — Aileen B Felton
(74) *Attorney, Agent, or Firm* — LRK Patent Law Firm

(57) ABSTRACT

This invention relates to a method of manufacturing a salt-coated heat paper, including preparing a powder mixture by mixing a fuel powder with an oxidant powder; preparing a slurry by adding an organic coagulant, after mixing the powder mixture with glass fibers; obtaining a heat paper by a papermaking process utilizing the slurry; primarily drying the heat paper by pressing; coating the heat paper with a salt solution; and secondarily drying the heat paper.

5 Claims, 6 Drawing Sheets

METHOD OF MANUFACTURING SALT-COATED HEAT PAPER AND SALT-COATED HEAT PAPER MANUFACTURED THEREBY

CROSS REFERENCE TO RELATED APPLICATION

This application claims the benefit of Korean Patent Application No. KR 10-2014-0036062, filed Mar. 27, 2014, which is hereby incorporated by reference in its entirety into this application.

TECHNICAL FIELD

The present invention relates to a method of manufacturing a salt-coated heat paper and a salt-coated heat paper manufactured thereby, and more particularly, to a method of manufacturing a salt-coated heat paper and a salt-coated heat paper manufactured thereby, wherein the salt-coated heat paper has sufficient physical properties (strength) so as to facilitate the handling of the heat paper, and the combustion temperature may be lowered without changing the tendency for a certain temperature upon combustion.

BACKGROUND $Zr/BaCrO_4$-based heat paper has been mainly utilized as a heat source for a thermal battery or as an ignition strip. A thermal battery is a kind of primary battery which is non-rechargeable. Since the electrolyte for a thermal battery is normally present in a solid phase having no ionic conductivity, it has no self-discharge and may thus be stored for a long period of time. A thermal battery is operated in such a manner that when an igniter or electric match is driven in response to an external signal as necessary, the generated flame may instantly combust a heat paper that is an ignition material, thus producing thermal energy, by which the heat, source is then ignited, and an electromotive force is generated while melting the solid electrolyte by the generated heat. However, when the combustion temperature of the heat paper is increased to a certain temperature or higher, the temperature of a battery stack in contact with the heat paper is increased to a temperature equal to or higher than a degradation temperature thereof, thus causing degradation of a cathode ($FeS_2$), melting of an anode (LiSi) and localized overheating, undesirably deteriorating battery performance. In severe cases, thermal runaway of the battery may occur.

SUMMARY

Accordingly, an object of the present invention is to provide a method of manufacturing a salt-coated heat paper, which enables a heat paper to be simply and cheaply manufactured via salt coating so that the internal temperature of a thermal battery is maintained constant to increase reliability, and in which the resulting heat paper may exhibit a sufficient strength so as to facilitate handling compared to conventional heat paper, and the combustion temperature may be lowered without changing the tendency for a certain temperature upon combustion.

In order to accomplish the above object, the present invention provides a method of manufacturing a salt-coated heat paper, comprising preparing a powder mixture by mixing a fuel powder with an oxidant powder; preparing a slurry by adding an organic coagulant, after mixing the powder mixture with glass fibers; obtaining a heat paper by a papermaking process utilizing the slurry; primarily drying the heat paper by pressing; coating the heat paper with a salt solution; and secondarily drying the heat paper.

In addition, the present invention provides a salt-coated heat paper manufactured by the above method.

According to the present invention, a salt-coated heat paper has sufficient physical properties (strength) so as to facilitate the handling thereof. When the heat paper is combusted by an igniter upon initial operation of a thermal battery, a predetermined amount of thermal energy generated from the inside of the heat paper is absorbed by the coated salt, thus lowering the combustion temperature, thereby preventing excessive heat flow into the heat source to block a negative influence on electrodes, and improving reliability of a thermal battery.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
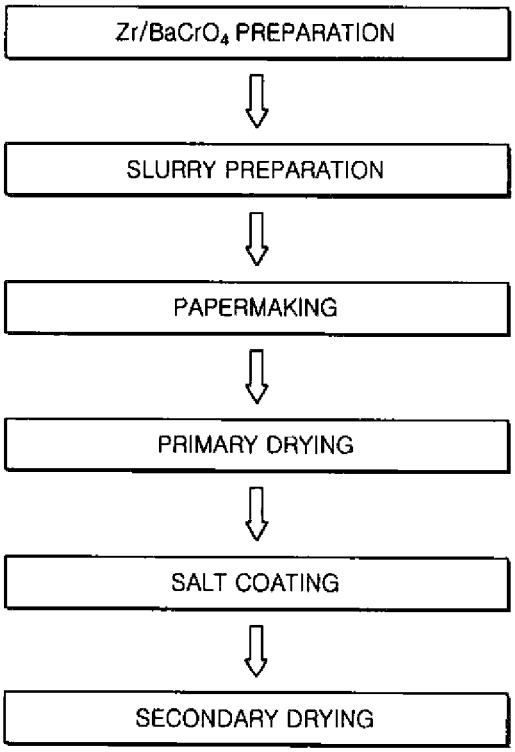
FIG. 1 is a block diagram illustrating a process of manufacturing a heat paper using salt coating according to the present invention.
Figure 2:
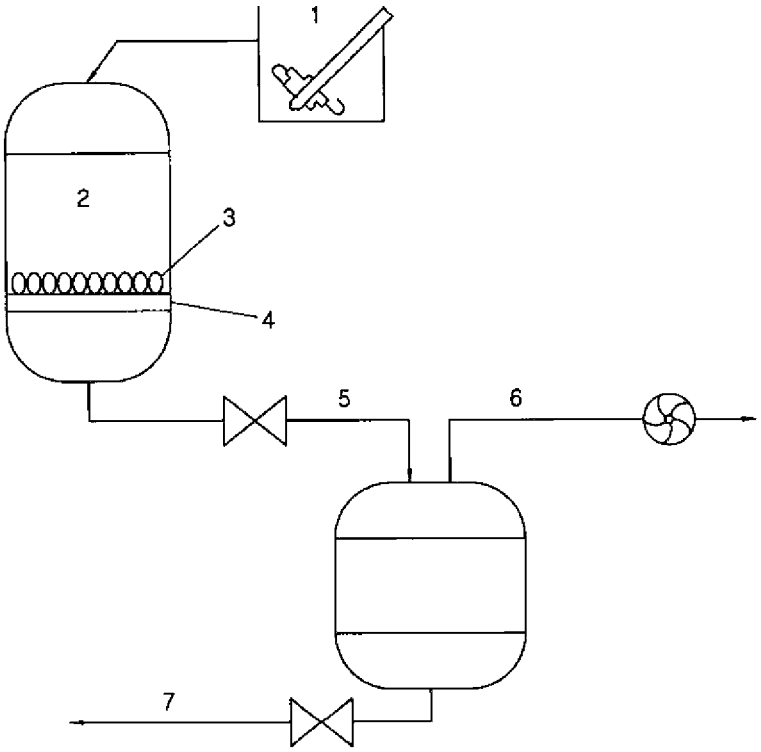
FIG. 2 is a schematic view illustrating a hand sheet machine for use in manufacturing the heat paper according to the present invention.

Hereinafter, a detailed description will be given of a method of decreasing the combustion temperature of a heat paper using salt coating according to the present invention, with reference to the appended drawings. As illustrated in FIGS. 1 and 2, the method of manufacturing a heat paper using salt coating includes preparing a powder mixture by mixing a fuel powder with an oxidant powder; preparing a slurry by adding an organic coagulant, after mixing the powder mixture with glass fibers; obtaining a heat paper by a papermaking process utilizing the slurry; primarily drying the heat paper by pressing; coating the heat paper with a salt solution; and secondarily drying the heat paper. Also, a heat paper manufactured by the above method is provided.

Specifically, upon preparing a powder mixture by mixing a fuel powder with an oxidant powder, Zr powder and $BaCrO_4$ powder are ground to a particle size of 1~100 μm. Examples of the grinder may include a ball mill, an automatic grinding mixer, a colloid mill and a shatter box. The powder may be sieved so as to obtain the corresponding particle size. 10~30 wt % of the ground Zr powder and 70~85 wt % of the ground $BaCrO_4$ powder are mixed together with the remainder of water using a ball mill mixer, a high speed mixer or a mechanical stirrer. The fuel powder may include any one or more selected from among Zr, Fe, Ni, Mg, Ti, W, B, Si, C, S, and P. The oxidant powder may include any one or more selected from among $BaCrO_4$, $KClO_4$, $KNO_3$, $BaNO_3$, $PbO_2$, $Pb_3O_4$, and $CaCrO_4$.

Upon slurry preparation, glass fibers are added to water and dissociated, after which $Zr/BaCrO_4$, is added and stirred, thus preparing the slurry. The glass fibers are placed in a grinder (Waring blender) together with the remainder of water so that the fibers are dissociated, and then $Zr/BaCrO_4$, may be added again and stirred 1~10 times at 14,000~19,000 rpm for about 1~10 min, thereby obtaining the slurry. The $Zr/BaCrO_4$, may be used in an amount of 10~15 parts by weight based on 1 part by weight of the glass fibers. The glass fibers used in the present invention may have an average length of 1~10 mm.

Subsequently, the slurry comprising the mixture of glass fibers and $Zr/BaCrO_4$ is transferred to a slurry tank (a stock chest) (S1), and then stirred with the addition of an organic coagulant, thus completing the slurry. The organic coagulant is used in an amount of 0.01~0.1 parts by weight based on 1 part by weight of the slurry. The organic coagulant is added to enhance the retention effects of glass fibers and $Zr/BaCrO_4$ in the slurry, provide an efficient flow of the slurry in the course of papermaking and primary drying for forming a heat paper slurry (S3), and enhance the binding force of glass fibers and $Zr/BaCrO_4$, so that $Zr/BaCrO_4$, does not escape together with white water (S7) during dewatering (S5, S6), after which the individual additives may be stirred at a stirring rate of 300~700 rpm for 3~30 min. Furthermore, the slurry is preferably maintained with weak stirring even after mixing of all the additives.

Upon papermaking, the obtained slurry is fed into a head box 2 through the slurry tank (stock chest) 1 of a papermaking machine. When the slurry is fed onto a wire mesh 4 to form the heat paper slurry 3, the thickness of the heat paper is determined, and the flow of the slurry is adjusted to uniformly distribute the slurry on the wire mesh 4, thereby obtaining a heat paper having uniformly distributed additives. Upon papermaking, the heat paper having a water content of 200~300% may be obtained from the slurry using a hand sheet machine. More specifically, the flow of the slurry occurs in the head box 2 of FIG. 2. This machine is not continuous, and uses a hand sheet machine to achieve simple processing, wherein the heat paper is prepared in a manual manner such that the slurry is placed in the head box 2 using a beaker and the valve of a natural dewatering unit 5 is opened to discharge water.

Upon primary drying, the heat paper is pressed using a roller, thus increasing the density of the heat paper to increase uniformity of the heat paper, and also the water content thereof is lowered to 50~100%, thus improving handling. If the heat paper uniformly distributed on the wire mesh 4 resulting from the papermaking step is unconditionally recovered, it has a water content of 200~300%, and hence, this primary drying step is carried out to overcome problems of low handling due to high water content.

Then, salt coating and heat paper drying are specified below. Upon salt coating, a salt powder is added to a solvent and allowed to stand for 5~30 min so that the salt particles are uniformly dispersed in the solvent, thus obtaining a mixed solution. The solvent is used in an amount of 100 parts by weight based on 1 part by weight of the salt powder. The solvent may include any one or more selected from among distilled water, ion exchange water and an organic solvent, and the salt may include any one or more selected from among KCl, NaCl, $MgCl_2$, LiCl, LiBr, LiF, NaF, KF, NaOH, NaCl—KCl, and NaCl—KCl—$MgCl_2$. Also, a larger amount of the salt may be mixed with the solvent. The heat paper obtained, by a series of steps from preparing the powder mixture to primarily drying the heat paper is sprayed with the salt solution and thus coated. When the solution is sprayed on the surface of the heat paper, a nonwoven fabric and aluminum foil may be placed under the heat paper, and thereby the heat paper may be easily released after salt coating. In order to prevent the solution from being sprayed on the same position in an overlapping manner, the solution is sprayed at selected points per coating.

After salt coating, the heat paper is secondarily dried at 60~100° C. for 4~24 hr, thus improving handling. This secondary drying step is performed to overcome problems of low handling due to the water contained in the salt-coated heat paper.

A better understanding of the present invention may be obtained through the following examples and test examples which are set forth to illustrate, but are not to be construed as limiting the scope of the present invention.

Example 1

21 wt % of Zr powder having an average particle size of 2 μm and 79 wt % of $BaCrO_4$ powder having an average particle size of 1 μm were mixed. 75 wt % of micro glass fibers and 25 wt % of glass fiber flock were dissociated together with an appropriate amount of water, after which 1250 parts by weight of the $Zr/BaCrO_4$ powder mixture based on 100 parts by weight of the glass fibers was placed in a grinder and stirred. To increase coagulation effects of the additives in the slurry, 0.1 parts by weight of a cationic organic coagulant polyacrylamide was added based on 100 parts by weight of glass fibers and $Zr/BaCrO_4$, and then stirred at a mechanical stirring rate of 800 rpm for 10 min, thus completing the slurry. The heat paper was prepared so that its basis weight was 810 $g/m^2$, and then subjected to pressing and drying, giving a heat paper sheet.

34 g of a salt (KCl, Potassium chloride) was added to 200 ml of distilled water and dissolved for 15 min so that the salt particles were uniformly dispersed, after which the salt was sprayed once using a sprayer at selected points on the surface of the heat paper so that the salt coating did not overlap, followed by drying at 70° C. for 6 hr, thereby obtaining a salt-coated heat paper.

Example 2

The heat paper prepared under the same conditions as in Example 1 was used. The subsequent procedures were performed in the same manner as in Example 1, with the exception that a mixed solution of salt and distilled water was sprayed two times on the surface of the heat paper using a sprayer.

Example 3

The heat paper prepared under the same conditions as in Example 1 was used. The subsequent procedures were performed in the same manner as in Example 1, with the exception that a mixed solution of salt and distilled water was sprayed three times on the surface of the heat paper using a sprayer.

Example 4

The heat paper prepared under the same conditions as in Example 1 was used. The subsequent procedures were performed in the same manner as in Example 1, with the exception that a mixed solution of salt and distilled water was sprayed four times on the surface of the heat paper using a sprayer.

Comparative Example 1

A heat paper was prepared under the same conditions as in Example 1, with the exception of salt coating.

The following is test examples for Examples 1 to 4 and Comparative Example 1.

Test Example 1

Test for Combustion Temperature

Figure 3:
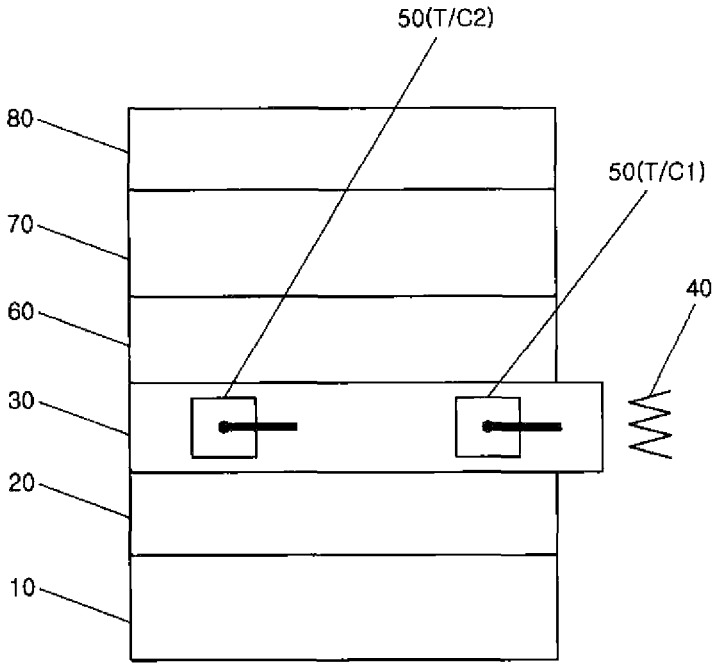
FIG. 3 is a view illustrating a stack structure for measuring the combustion temperature of a heat paper according to the present invention.
Figure 4:
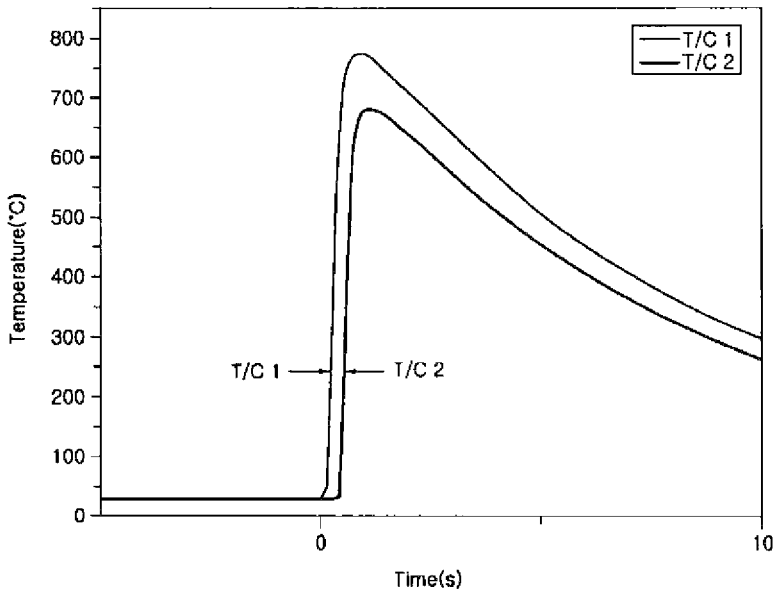
FIG. 4 is a graph (1) illustrating the results of measurement of the combustion temperature of heat papers of Comparative Example and Examples of the present invention.

The combustion temperature of the heat paper of each of Examples 1 to 4 and Comparative Example 1 was measured using a self-made jig of FIG. 3. The results are shown in Table 1 below and FIGS. 4 and 5. The heat paper 30 was placed on an electrical insulation material 20 on a heat insulation material 10, and thermocouples (T/C) 50 were spaced apart from each other at an interval of about 6 cm on both ends of the heat paper. Then, an electrical insulation material 60 and a heat insulation material 70 were sequentially placed thereon, and a Cu plate 80 was further placed to apply a proper load. Thereafter, the heat paper was ignited by an igniter 40. While the heat paper was combusted, the combustion temperature values as shown in FIG. 4 could be obtained, by the T/C 1 close to the igniter 40 and the T/C 2 distant from the igniter 40.

TABLE 1

| Sample | | C. Ex. 1 | Ex. 1 | Ex. 2 | Ex. 3 | Ex. 4 |
|---|---|---|---|---|---|---|
| T/C 1 | 1 | 911.1 | 773.8 | 738.2 | 676.5 | 651.6 |
| Combustion | 2 | 710.7 | 708.8 | 709.4 | 636.7 | 620.2 |
| Temp. | 3 | 739.9 | 750.1 | 703.5 | 625.3 | 575.5 |
| | 4 | 860.9 | 778.5 | 667.7 | 618.3 | 500.4 |
| | 5 | 863.3 | 656.1 | 648.8 | 596.7 | 509.3 |
| Average | | 817.2 | 733.4 | 693.5 | 630.7 | 571.4 |
| T/C 2 | 1 | 821.8 | 680.9 | 665.8 | 615.3 | 611.1 |
| Combustion | 2 | 812.8 | 660.2 | 626.3 | 527.9 | 506.2 |
| Temp. | 3 | 747.5 | 704.4 | 644.0 | 495.3 | 449.1 |
| | 4 | 822.1 | 704.0 | 590.2 | 450.6 | 439.2 |
| | 5 | 844.5 | 831.5 | 522.1 | 391.2 | 293.6 |
| Average | | 809.7 | 716.2 | 609.7 | 496.1 | 459.8 |

Unit: ° C.

FIG. 4 typically illustrates the measured combustion temperature data. By use of the above measurement method, the combustion temperature of the heat paper of each of Comparative Example 1 and Examples 1 to 4 was measured five times. The results are summarized in Table 1 below, and graphed in FIG. 5.

Figure 5:
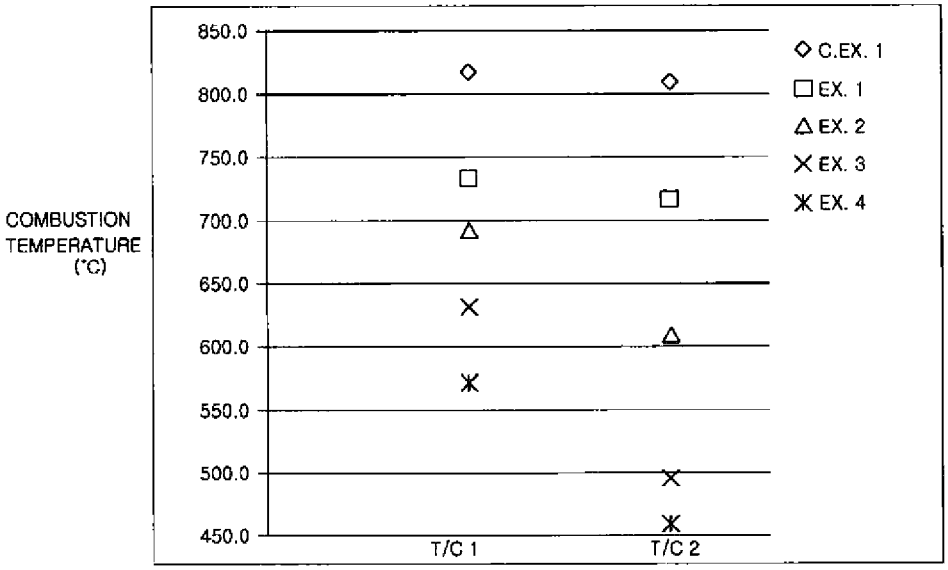
FIG. 5 is a graph (2) illustrating the results of measurement of the combustion temperature of heat papers of Comparative Example and Examples of the present invention.

As is apparent from Table 1 and FIG. 5, the average combustion temperatures of Comparative Example 1 without the addition of the salt (KCl, Potassium chloride) were 817.2° C. (T/C 1) and 809.7° C. (T/C 2), and in Examples 1 to 4 with the addition of the salt, the combustion temperatures upon one salt coating were 733.4° C. (T/C 1) and 716.2° C. (T/C 2), and the combustion temperatures upon four salt coatings were 571.4° C. (T/C 1) and 459.8° C. (T/C 2). As the number of salt coating processes increased, the combustion temperature was gradually lowered, and physical properties (strength) were enhanced. Based on such results, the salt is uniformly distributed on and in the heat paper, and can thus function as a salt coolant for absorbing heat generated upon oxidation of $Zr/BaCrO_4$. Furthermore, a desired certain temperature can be set depending on the number of salt coating processes.

Test Example 2

Test for Heating Value

Each of the heat papers of Examples 1 to 4 and Comparative Example 1 was weighed, placed in the reactor of a Bombe calorimeter (Parr 6100 Compensated Jacket calorimeter), charged with argon gas to make the inside inert, and then measured for heating value. The results are shown in Table 2 below and FIG. 6.

TABLE 2

| | Heating value (cal/g) | | | |
|---|---|---|---|---|
| Sample | 1 | 2 | 3 | Average |
| C. Ex. 1 | 390.5 | 420.5 | 443.6 | 418.2 |
| Ex. 1 | 395.2 | 397.9 | 419.4 | 404.2 |
| Ex. 2 | 375.5 | 388.2 | 398.3 | 387.3 |
| Ex. 3 | 331.8 | 350.0 | 356.4 | 346.1 |
| Ex. 4 | 327.9 | 332.3 | 350.0 | 336.7 |

Unit: Cal/g

Figure 6:
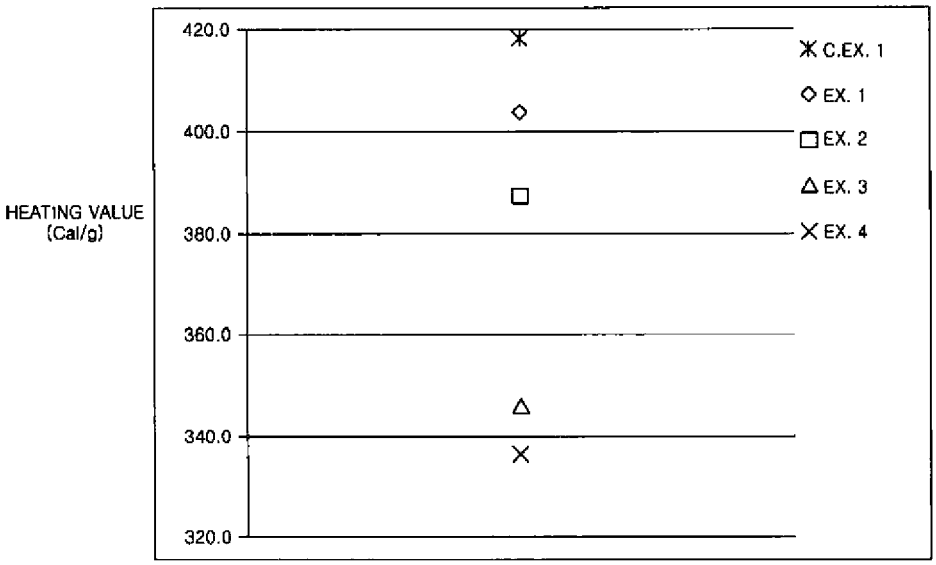
FIG. 6 is a graph illustrating the results of measurement of the heating value of heat papers of Comparative Example and Examples of the present invention.

As is apparent from Table 2 and FIG. 6, the heating value of Comparative Example 1 not coated with the salt was measured to be 418.2 Cal/g and the heating values of Examples 1 to 4 coated with the salt were gradually lowered to 404.2 Cal/g, 387.3 Cal/g, 346.1 Cal/g, and 336.7 Cal/g with an increase in the number of salt coating processes. As the proportion of the salt in the heat paper increases, the amount of absorbed heat is increased upon oxidation of $Zr/BaCrO_4$, in the heat paper, thus decreasing the heating value.

Test Example 3

Test for Ignition Sensitivity of Heat Paper

The ignition sensitivity of the heat paper of each of Examples 1 to 4 and Comparative Example 1 was tested. The results are shown in Table 3 below. The ignition sensitivity of the heat paper was measured using a laser power method or a method of measuring ignition performance of the heat paper in a furnace at different temperatures. This test was simply performed using a $CO_2$ laser system (Lasun-25, Medsun Co., Korea), and ignition performance was evaluated at an injection power of 1 W 10 ms (0.0024 cal/g) corresponding to the minimum resolution of an ignition system. As shown in Table 3 below, all the samples of Examples 1 to 4 and Comparative Example 1 were immediately ignited.

TABLE 3

| | Ignition sensitivity of heat paper | | |
|---|---|---|---|
| Sample | 1 | 2 | 3 |
| C. Ex. 1 | Ignition | Ignition | Ignition |
| Ex. 1 | Ignition | Ignition | Ignition |
| Ex. 2 | Ignition | Ignition | Ignition |
| Ex. 3 | Ignition | Ignition | Ignition |
| Ex. 4 | Ignition | Ignition | Ignition |

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of manufacturing a salt-coated heat paper, comprising:

preparing a powder mixture by, mixing a fuel powder with an oxidant powder;

preparing a slurry by adding an organic coagulant, after mixing the powder mixture with glass fibers;

obtaining a heat paper by a papermaking process utilizing the slurry;

primarily drying the heat paper by pressing;

coating the heat paper with a salt solution; and secondarily drying the heat paper, after coating the heat paper with the salt solution, wherein coating the heat paper with the salt solution enables a combustion temperature of the heat paper to be controlled depending on a number of salt coating processes, wherein coating the heat paper with the salt solution enables a heating value of the heat paper to be controlled depending on a number of salt coating processes, and wherein as the number of salt coating processes increases, the combustion temperature is gradually lowered, and physical properties of the salt-coated heat paper are enhanced.

2. The method of claim 1, wherein the fuel powder comprises at least one selected from among Zr, Fe, Ni, Mg, Ti, W, B, Si, C, S, and P.

3. The method of claim 1, wherein the oxidant powder comprises at least one selected from among $BaCrO_4$, $KClO_4$, $KNO_3$, $BaNO_3$, $PbO_2$, $Pb_3O_4$, and $CaCrO_4$.

4. The method of claim 1, wherein a solvent for the salt solution comprises at least one selected from among distilled water, ion exchange water, and an organic solvent.

5. The method of claim 1, wherein a salt of the salt solution comprises at least one selected from among KCl, NaCl, $MgCl_2$, LiCl, LiBr, LiF, NaF, KF, NaOH, NaCl—KCl, and NaCl—KCl—$MgCl_2$.

* * * * *